US009886890B2

(12) United States Patent
Lu et al.

(10) Patent No.: US 9,886,890 B2
(45) Date of Patent: Feb. 6, 2018

(54) DISPLAY DEVICE AND METHOD FOR DISPLAYING AN IMAGE THEREON

(71) Applicants: SHENZHEN CHINA STAR OPTOELECTRONICS TECHNOLOGY CO., LTD., Shenzhen (CN); WUHAN CHINA STAR OPTOELECTRONICS TECHNOLOGY CO., LTD., Wuhan, Hubei (CN)

(72) Inventors: Yucheng Lu, Shenzhen (CN); Xiang Yang, Shenzhen (CN); Xiaoping Tan, Shenzhen (CN)

(73) Assignees: SHENZHEN CHINA STAR OPTOELECTRONICS TECHNOLOGY CO., LTD., Shenzhen (CN); WUHAN CHINA STAR OPTOELECTRONICS TECHNOLOGY CO., LTD., Wuhan (CN)

( * ) Notice: Subject to any disclaimer, the term of this patent is extended or adjusted under 35 U.S.C. 154(b) by 169 days.

(21) Appl. No.: 14/897,126

(22) PCT Filed: Oct. 9, 2015

(86) PCT No.: PCT/CN2015/091537

§ 371 (c)(1),
(2) Date: Dec. 9, 2015

(87) PCT Pub. No.: WO2017/049667

PCT Pub. Date: Mar. 30, 2017

(65) Prior Publication Data

US 2017/0193882 A1 Jul. 6, 2017

(51) Int. Cl.
*G09G 3/20* (2006.01)

(52) U.S. Cl.
CPC ..... *G09G 3/2092* (2013.01); *G09G 3/2007* (2013.01); *G09G 2310/0243* (2013.01);
(Continued)

(58) Field of Classification Search
CPC ..... G09G 2310/0243; G09G 2310/08; G09G 2320/0257; G09G 2330/02; G09G 3/2007; G09G 3/2092
See application file for complete search history.

(56) References Cited

U.S. PATENT DOCUMENTS

2007/0164947 A1 7/2007 Lin et al.
2008/0158126 A1* 7/2008 Tung ..... G09G 3/3648 345/92

(Continued)

FOREIGN PATENT DOCUMENTS

CN 101452675 A 6/2009
CN 101546528 A 9/2009

(Continued)

*Primary Examiner* — Dmitriy Bolotin
(74) *Attorney, Agent, or Firm* — Osha Liang LLP

(57) ABSTRACT

A display device and a method for displaying an image thereof are disclosed. The display device includes a display panel, a gray scale voltage output circuit, a common voltage output circuit and a control circuit. The display panel, according to a first gray scale voltage signal and a first common voltage signal, display an image; the control circuit is used for controlling the gray scale voltage output circuit and the common voltage output circuit to output a second gray scale voltage signal and a second common voltage to the display panel when at a predetermined time to display another image. The present invention can cause the blink rate to be maintained over time at a relatively stable range.

7 Claims, 7 Drawing Sheets

(52) U.S. Cl.
CPC . *G09G 2310/08* (2013.01); *G09G 2320/0257* (2013.01); *G09G 2330/02* (2013.01)

(56) References Cited

U.S. PATENT DOCUMENTS

| | | | | |
|---|---|---|---|---|
| 2008/0186266 | A1* | 8/2008 | Takahashi | G09G 3/3688 345/87 |
| 2009/0243987 | A1 | 10/2009 | Chang et al. | |
| 2009/0289928 | A1* | 11/2009 | Shi | G09G 3/3614 345/209 |
| 2010/0045708 | A1* | 2/2010 | Higashino | G09G 3/3685 345/690 |
| 2015/0379954 | A1* | 12/2015 | Choi | G09G 3/3696 345/690 |
| 2016/0343317 | A1 | 11/2016 | Syu | |

FOREIGN PATENT DOCUMENTS

| | | | |
|---|---|---|---|
| CN | 101826314 | A | 9/2010 |
| CN | 103185974 | A | 7/2013 |
| CN | 104240661 | A | 12/2014 |
| CN | 104347048 | A | 2/2015 |
| KR | 20070070926 | A | 7/2007 |

* cited by examiner

DISPLAY DEVICE AND METHOD FOR DISPLAYING AN IMAGE THEREON

TECHNICAL FIELD

The present invention relates to the field of display technology, and more particularly to a display device and a method for displaying an image thereon.

BACKGROUND OF THE INVENTION

In the conventional TFT-LCD (Thin Film Transistor Liquid Crystal Display), there is often parasitic capacitance Cgd. When the current/voltage of the gate line changes, the parasitic capacitance Cgd will produce the capacitive coupling (Feed Through) voltage ΔV, so that it cannot use the common voltage Vcom as a middle value in respect to which the voltage changes symmetrically when the voltage forms polarity inversion, which causes DC residual effects to appear.

Under the influence of the DC residual effects above, if the voltage of the bipolar plate of LCD capacitive of the thin film transistor liquid crystal display panel remains the same value for a long time, then the residual and movable ions in the liquid crystal molecules can move in the same electric field direction to accumulate on the same side of the liquid crystal molecules, thereby forming an inner electric field.

When the displaying image (as shown in FIG. 1) of the thin film transistor liquid crystal display turns from a high gray scale to a low gray scale, the inner electric field and the electric field between the plates of the liquid crystal capacitance are offset with each other, so that the liquid crystal molecules cannot be twisted to a predetermined angle, which will eventually lead to an image sticking phenomenon, as shown in FIG. 2.

In particular, in the process of users who use mobile phones, tablet computers, desktop computers, and other electronic products, since the screen area of the electronic products will sometimes display a static picture for a long time. When the screen is switched, the screen of the electronic products will produce an image sticking phenomenon which is easily recognizable to the human eye.

In order to reduce the above image sticking phenomenon, the conventional technical solutions are: the asymmetric adjustment is used to grayscale voltage which is used to display images.

Due to the nature of the portion of parts or materials of the conventional displaying panel (e.g., the nature of the liquid crystal material) having variations over time (changing with time and having varying characteristics), the optimum common voltage value of the conventional display panel will vary with time variation, and the above portion of parts or materials of the conventional displaying panel are able to stabilize after booting for a long time. During this long time, if the Vcom, etc., are kept constant, then the flicker rate of the conventional display panel image will be in a variation state continuously, as shown in FIG. 3, which would greatly increase the image sticking phenomenon.

Therefore, it is necessary to propose a new technical solution to solve the above technical problems.

SUMMARY OF THE INVENTION

The object of the present invention is to provide a display device and a method for displaying an image thereof, which can make the blink rate of a display image of the display device vary with time to be kept within a stable range, thereby improving the display quality.

In order to solve the above problems, the technical solutions of the present invention are as follows: A display device, comprising: a display panel, used for displaying an image according to a first gray scale voltage signal and a first common voltage signal; a gray scale voltage output circuit, used for outputting the first gray scale voltage signal to the display panel; a common voltage output circuit, used for outputting the first common voltage signal to display panel; and a control circuit being used at the predetermined time for controlling the gray scale voltage output circuit and the common voltage output circuit respectively outputting the second gray scale voltage signal and the second common voltage to the display panel; wherein the second gray scale voltage signal and the second common voltage signal are supplied to the display panel for displaying another image, and for causing a blink rate of the displayed image of the display panel to be within a predetermined range; the display device further comprising: a timer, used for calculating a display time of the display panel; the control circuit used for deciding whether the predetermined time arrives or not in accordance with the display time, when at the predetermined time, controlling the gray scale voltage output circuit and the common voltage output circuit respectively to output the second gray scale voltage signal and the second common voltage signal to the display panel; the gray scale voltage output circuit and the common voltage output circuit both connect to the display panel, and the control circuit connects with the gray scale voltage output circuit and the common voltage output circuit.

In the display device above, the display device further comprises: a memory used for storing therein a second gray scale voltage value and a second common voltage value in advance; a control circuit reads the second gray scale voltage value and the second common voltage value from the memory when at the predetermined time, and according to the second gray scale voltage value and the second common voltage value, controls the gray scale voltage output circuit and the common voltage output circuit respectively to output the second gray scale voltage signal and the second common voltage to the display panel; wherein the second gray scale voltage signal is corresponding to the second gray scale voltage value, the second common voltage signal is corresponding to the second common voltage value.

In the display device above, the memory stores a set of preset data, the set of preset data includes a time information, at least one of the second gray voltage values and at least one of the second common voltage values; the second gray scale voltage value and the second common voltage value both corresponding to the time information; the control circuit used for comparing the display time with the time corresponding to the time information, and generating a comparison result, according to the comparison result, reads the second gray scale voltage value and the second common voltage value from the memory when at the predetermined time, and according to the second gray scale voltage value and the second common voltage value, controls the gray scale voltage output circuit and the common voltage output circuit respectively to output the second gray scale voltage signal and the second common voltage to the display panel.

In the display device above, the second gray voltage value and the second common voltage value are previously measured according to the display panel samples at different times points, in order to keep the blink rate of the image which is within the predetermined range of the desired gray scale voltage signal and the common voltage signal.

In the display device above, the display device comprises: a display panel, which according to a first gray scale voltage signal and a first common voltage signal, displays an image; a gray scale voltage output circuit, used for outputting the first gray scale voltage signal to the display panel; a common voltage output circuit, used for outputting the first common voltage signal to the display panel; and a control circuit controls the gray scale voltage output circuit and the common voltage output circuit respectively to output a second gray scale voltage signal and a second common voltage to the display panel when at the predetermined time; wherein the second gray scale voltage signal and the second common voltage signal are supplied to the display panel for displaying another image, and for causing a blink rate of the displayed image of the display panel to be within a predetermined range.

In the display device above, the display device further comprises: a timer, used for calculating a display time of the display panel; a control circuit used for deciding whether the predetermined time arrives or not, in accordance with the display time, when at the predetermined time, controls the gray scale voltage output circuit and the common voltage output circuit respectively to output the second gray scale voltage signal and the second common voltage signal to the display panel.

In the display device above, the display device further comprises: a memory for storing therein a second gray scale voltage value and a second common voltage value in advance; a control circuit reads the second gray scale voltage value and the second common voltage value from the memory when at the predetermined time, and according to the second gray scale voltage value and the second common voltage value, controls the gray scale voltage output circuit and the common voltage output circuit respectively to output the second gray scale voltage signal and the second common voltage to the display panel.

In the display device above, the second gray scale voltage signal corresponds to the second gray scale voltage value, the second common voltage signal corresponds to the second common voltage value.

In the display device above, the memory stores a set of preset data, the set of preset data includes a time information, at least one of the second gray voltage values, and at least one of the second common voltage values; the second gray scale voltage value and the second common voltage value both corresponding to the time information.

In the display device above, the control circuit compares the display time with the time corresponding to the time information, and generates a comparison result, according to the comparison result, the control circuit reads the second gray scale voltage value and the second common voltage value from the memory when at the predetermined time, and according to the second gray scale voltage value and the second common voltage value, the control circuit controls the gray scale voltage output circuit and the common voltage output circuit respectively to output the second gray scale voltage signal and the second common voltage to the display panel.

In the display device above, the second gray voltage value and the second common voltage value are previously measured according to the display panel samples at different time points, in order to keep the blink rate of the image within the predetermined range of the desired gray scale voltage signal and the common voltage signal.

In the display device above, the gray scale voltage output circuit and the common voltage output circuit are both connected to the display panel, and the control circuit is connected with the gray scale voltage output circuit and the common voltage output circuit.

A method for displaying an image of the display device above, the method including steps below: A, the gray scale voltage output circuit and the common voltage output circuit, respectively are used for outputting a first gray scale voltage signal, and used for outputting a first common voltage signal to the display panel; B, the display panel displays an image according to the first gray scale voltage signal and the first common voltage signal; and C, when at a predetermined time thereafter, the control circuit controlling the gray scale voltage output circuit and the common voltage output circuit respectively and outputting a second gray scale voltage signal and a second common voltage to the display panel; wherein the second gray scale voltage signal and the second common voltage signal are supplied to the display panel for displaying another image, and for causing the blink rate of the displayed image of the display panel to be within a predetermined range.

A method for displaying an image of the display device above, the method furthermore includes the following steps below: Step D, having the timer to calculate a display time of the display panel; step C including the following steps: c1, the control circuit, in accordance with the display time, deciding whether the predetermined time arrives or not; and c2, when at the predetermined time, controlling the gray scale voltage output circuit and the common voltage output circuit respectively and outputting the second gray scale voltage signal and the second common voltage signal to the display panel.

A method for displaying an image of the display device above, the step c2 including the following steps: c21, the control circuit reads the second gray scale voltage value and the second common voltage value from the memory when at the predetermined time; and c22, according to the second gray scale voltage value and the second common voltage value, controlling the gray scale voltage output circuit and the common voltage output circuit respectively and outputting the second gray scale voltage signal and the second common voltage to the display panel.

A method for displaying an image of the display device above, the second gray scale voltage signal corresponds to the second gray scale voltage value, the second common voltage signal corresponds to the second common voltage value.

A method for displaying an image of the display device above, the memory stores a set of preset data therein, the set of preset data including a time information, at least one of the second gray voltage values and at least one of the second common voltage values, the second gray scale voltage value and the second common voltage value both correspond to the time information.

A method for displaying an image of the display device above, the step c1 including the following step: c11, the control circuit comparing the display time with the time corresponding to the time information, and generating a comparison result; the step c21 includes the following step: c211, according to the comparison result, when at the predetermined time, the control circuit reading the second gray scale voltage value and the second common voltage value from the memory.

A method for displaying an image of the display device above, the second gray voltage value and the second common voltage value are previously measured according to the display panel samples at different time points, in order to keep the blink rate of the image within the predetermined range of the desired gray scale voltage signal and the common voltage signal.

Relative to the prior art, the present invention can make the blink rate of display image of the display device vary with time to be kept within a stable range, thereby improving display quality.

To allow the above present invention to be more clearly comprehensible, preferred embodiments, with the accompanying drawings, are described in detail below.

DETAILED DESCRIPTION OF THE INVENTION

Regarding the terms as used in this specification, "an embodiment" means an instance, an example, or an illustration. In addition, the articles in this specification and the appended claims, the use of "one" in general can be interpreted as "one or more" unless specified otherwise or clear from context to determine the singular form.

Figure 1:
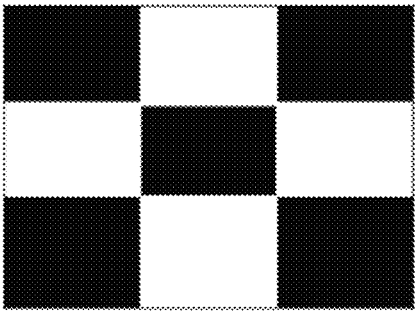
FIG. 1 is a schematic diagram of the displayed image of a conventional display panel.
Figure 2:
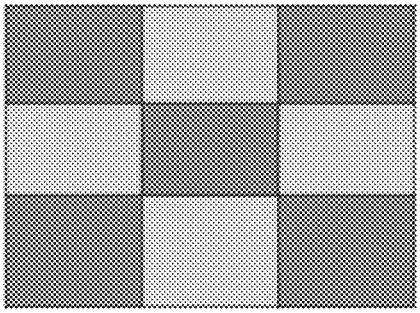
FIG. 2 is a schematic diagram of an image sticking phenomenon of the displayed image obtained from the displayed image shown in FIG. 1.
Figure 3:
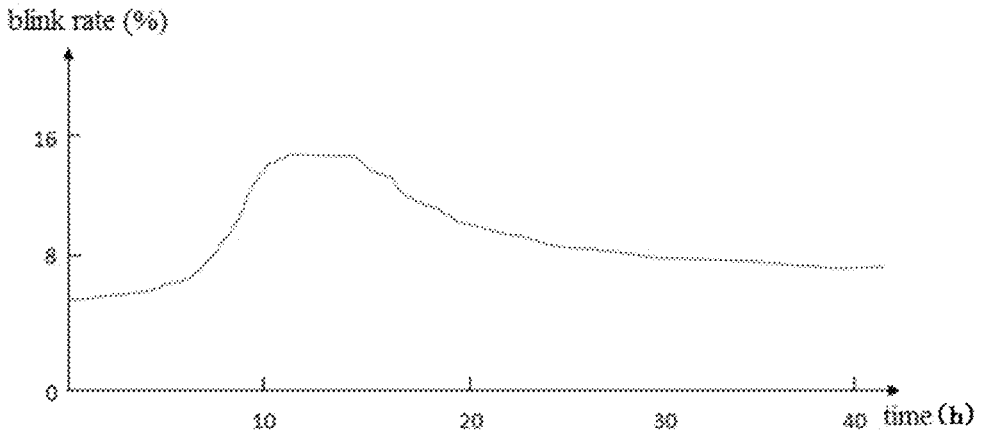
FIG. 3 is a schematic diagram of the conventional display panel flicker rate in respect to time.
Figure 4:
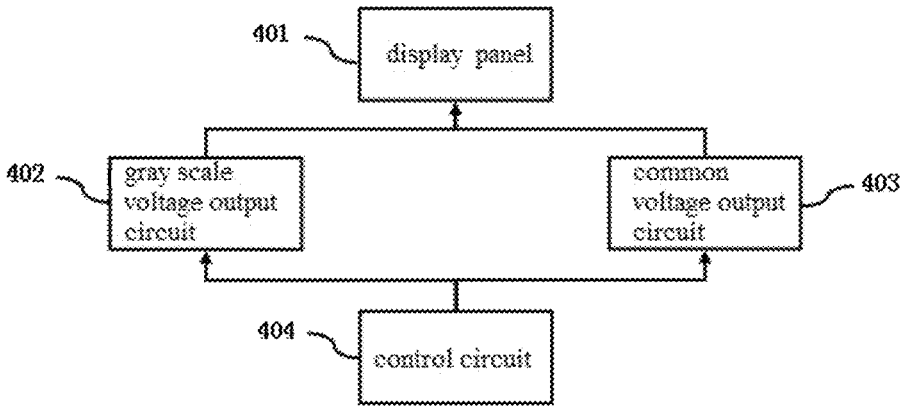
FIG. 4 is a block diagram of a first embodiment of the display device of the present invention.

Please refer to FIG. 4, which is a block diagram of a first embodiment of the display device of the present invention.

The display device of the present embodiment includes a display panel 401, a gray scale voltage output circuit 402, a common voltage output circuit 403, and a control circuit 404. The gray scale voltage output circuit 402 and the common voltage output circuit 403 are connected with the display panel 401. The control circuits 404 is connected with the gray-scale voltage output circuit 402 and the common voltage output circuit 403. The display panel 401 may be a TFT-LCD (Thin Film Transistor Liquid Crystal Display) panel, OLED (Organic Light Emitting Diode Display) panel, and the like.

The display panel 401, according to a first gray scale voltage signal and a first common voltage signal, displaying an image; the gray scale voltage output circuit 402 is used for outputting the first gray scale voltage signal to the display panel 401; the common voltage output circuit 403 is used for outputting the first common voltage signal to display panel 401; and the control circuit 404, when at the predetermined time, controls the gray scale voltage output circuit 402 and the common voltage output circuit 403 respectively and outputs the second gray scale voltage signal and the second common voltage to the display panel 401.

The second gray scale voltage signal and the second common voltage signal are supplied to the display panel 401 for displaying another image, and for causing a blink rate of the displayed image of the display panel 401 to be within a predetermined range.

Through the technical solution above, the blink rate can be maintained over time in a relatively fixed range (the predetermined range), thereby improving display quality.

Figure 5:
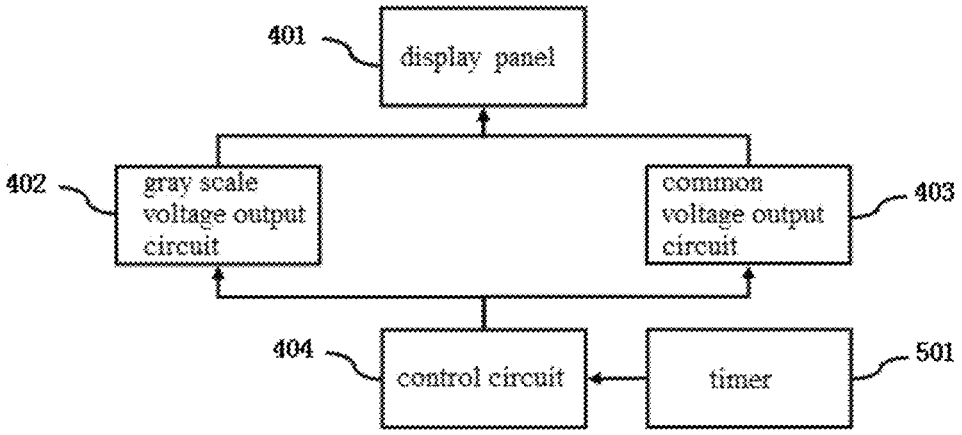
FIG. 5 is a block diagram of a second embodiment of the display device of the present invention.

Please refer to FIG. 5, which is a block diagram of a second embodiment of the display device of the present invention.

The present embodiment is similar to the first embodiment, except that in the present embodiment, the display device further includes a timer 501.

The timer 501 is used for calculating a display time of the display panel 401.

The control circuit 404, in accordance with the display time, is used for deciding whether the predetermined time arrives or not, and when at the predetermined time, controls the gray scale voltage output circuit 402 and the common voltage output circuit 403 respectively to output the second gray scale voltage signal and the second common voltage signal to the display panel 401.

Figure 7:
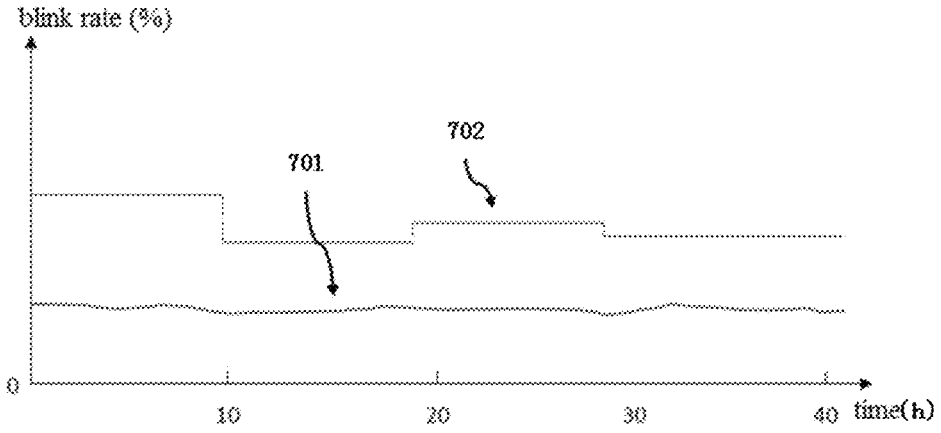
FIG. 7 is a schematic diagram of the display panel flicker rate in respect to time in accordance with the display device of the present invention.

As shown in FIG. 7, the line 702 corresponding to a second common voltage value which is different at different time periods, i.e., the second common voltage varies over time, and the blink rate corresponding to the curve line 701 that varies over time remains stable.

Figure 6:
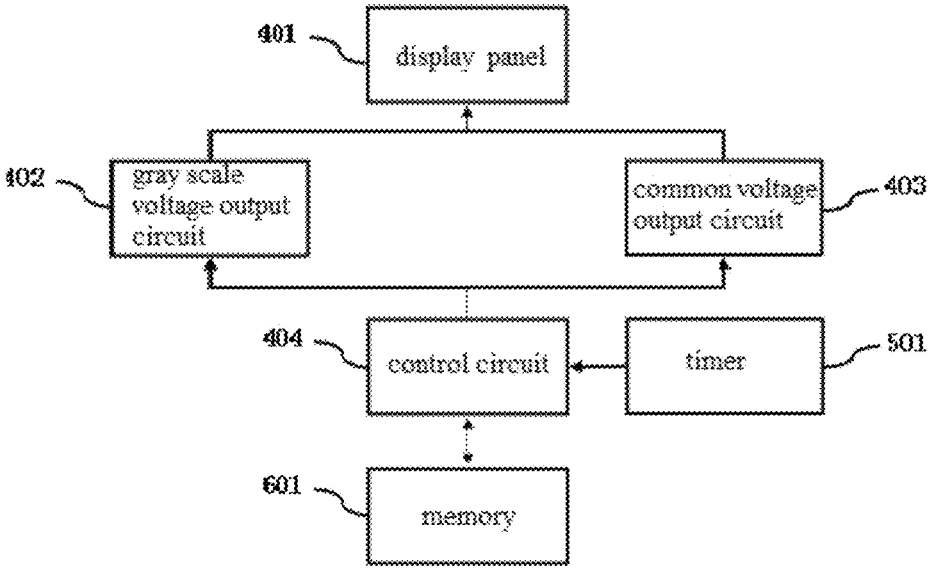
FIG. 6 is a block diagram of a third embodiment of the display device of the present invention.

Please refer to FIG. 6, which is a block diagram of a third embodiment of the display device of the present invention.

The present embodiment is similar to the second embodiment, except that in the present embodiment, the display device further includes a memory 601.

The memory 601 is used for storing therein a second gray scale voltage value and a second common voltage value in advance.

The control circuit 404, when at the predetermined time, is used for reading the second gray scale voltage value and the second common voltage value from the memory 601, and according to the second gray scale voltage value and the second common voltage value, controls the gray scale voltage output circuit 402 and the common voltage output circuit 403 respectively for outputting the second gray scale voltage signal and the second common voltage to the display panel 401.

The second gray scale voltage signal corresponds to the second gray scale voltage value, the second common voltage signal corresponds to the second common voltage value.

The fourth embodiment of the present invention is similar to the third embodiment, except that:

In the present embodiment, the memory 601 stores a set of preset data, the set of preset data includes a time information, at least one of the second gray voltage values, and at least one of the second common voltage values.

The second gray scale voltage value and the second common voltage value both correspond to the time information.

The control circuit 404 is used for comparing the display time with the time corresponding to the time information, and generating a comparison result. According to the comparison result, when at the predetermined time, it is used for reading the second gray scale voltage value and the second common voltage value from the memory 601, and according to the second gray scale voltage value and the second common voltage value, it is used for controlling the gray scale voltage output circuit 402 and the common voltage output circuit 403 respectively for outputting the second gray scale voltage signal and the second common voltage to the display panel 401.

The second gray voltage value and the second common voltage value are previously measured according to the display panel samples at different time points, in order to keep the blink rate of the image within the predetermined range of the desired gray scale voltage signal and the common voltage signal.

Figure 8:
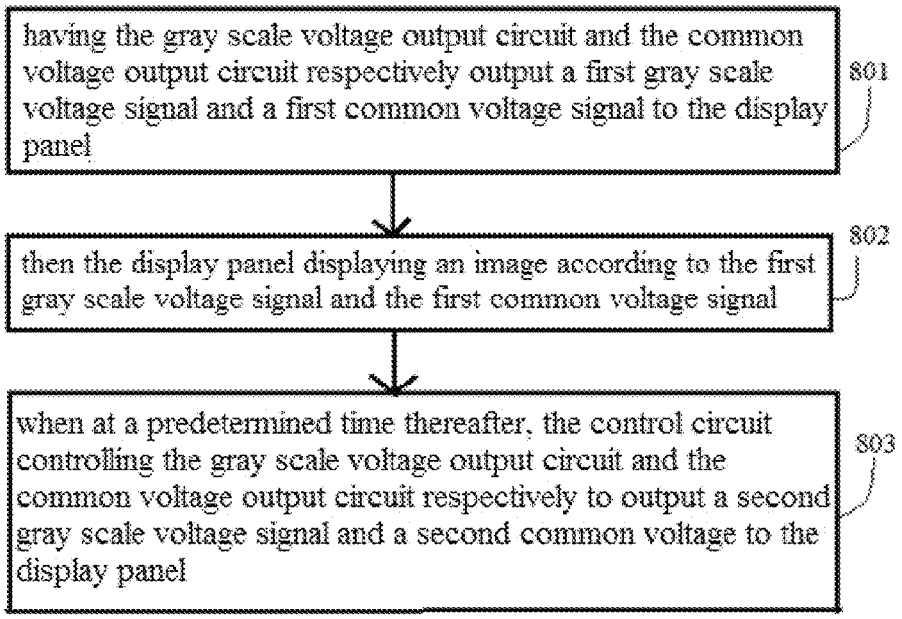
FIG. 8 is a flowchart of a first embodiment of a method for the display device displaying an image of the present invention.

Please refer to FIG. 8, which is a flowchart of a first embodiment of a method for the display device displaying an image of the present invention.

A method for a display device to display images, the display device comprising a display panel, a gray scale voltage output circuit in connection with the display panel, a common voltage output circuit in connection with the display panel, and a control circuit in connection with both the gray scale voltage output circuit and the common voltage output circuit, wherein the method includes the following steps:

A (Step 801), having the gray scale voltage output circuit 402 and the common voltage output circuit 403 are respectively used for outputting a first gray scale voltage signal and a first common voltage signal to the display panel 401.

B (Step 802), then the display panel 401 displays an image according to the first gray scale voltage signal and the first common voltage signal; and C (Step 803), when at a predetermined time thereafter, the control circuit 404 is used for controlling the gray scale voltage output circuit 402 and the common voltage output circuit 403 respectively for outputting a second gray scale voltage signal and a second common voltage to the display panel 401.

The second gray scale voltage signal and the second common voltage signal are supplied to the display panel 401 for displaying another image, and for causing the blink rate of the displayed image of the display panel 401 to be within a predetermined range.

Through the technical solution above, the blink rate can be maintained over time in a relatively fixed range (the predetermined range), thereby improving display quality.

Figure 9:
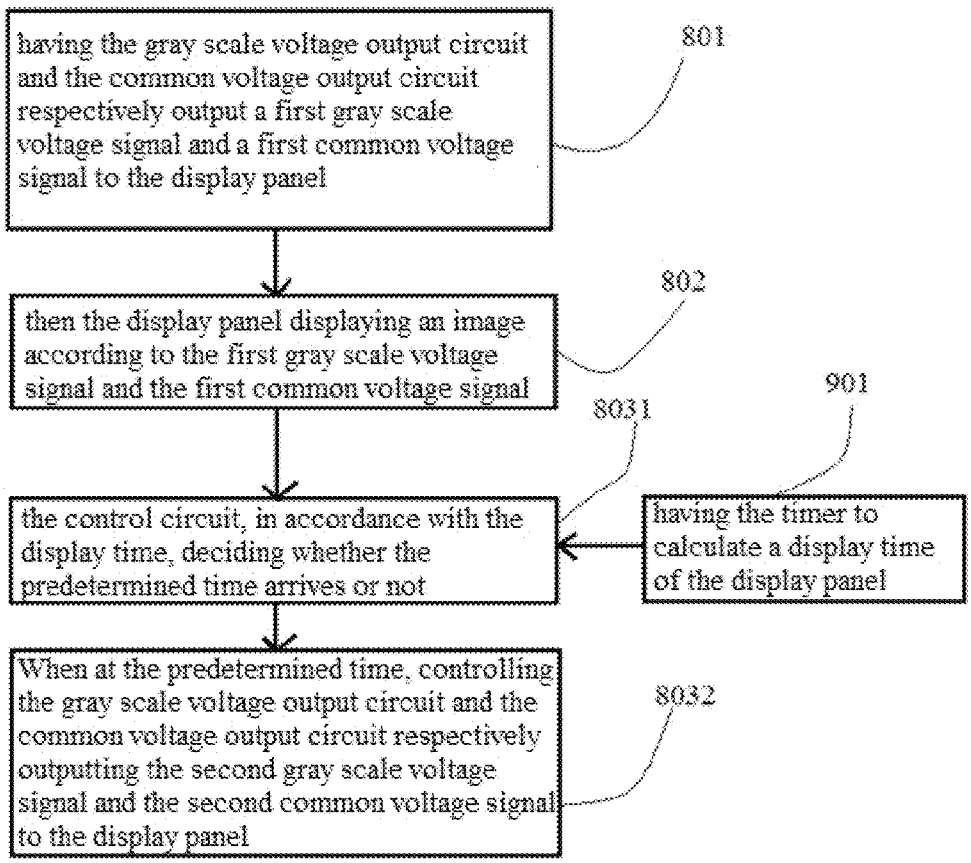
FIG. 9 is a flowchart of a second embodiment of a method for the display device displaying an image of the present invention.

Please refer to FIG. 9, which is a flowchart of a second embodiment of a method for the display device displaying an image of the present invention. The present embodiment is similar to the first embodiment, except that:

In the present embodiment, the display device further comprising a timer, the method further includes:

D (Step 901), having the timer 501 to calculate a display time of the display panel 401.

The step C (i.e., Step 803) includes the following steps:

c1 (Step 8031), the control circuit 404, in accordance with the display time, is used for deciding whether the predetermined time arrives or not; and c2 (Step 8032), when at the predetermined time, controlling the gray scale voltage output circuit 402 and the common voltage output circuit 403 respectively to output the second gray scale voltage signal and the second common voltage signal to the display panel 401.

As can be seen from FIG. 7, the line 702 corresponding to a second common voltage value is different at different time periods, i.e., the second common voltage varies over time, and the blink rate corresponding to the curve line 701 that varies over time remains stable.

Figure 10:
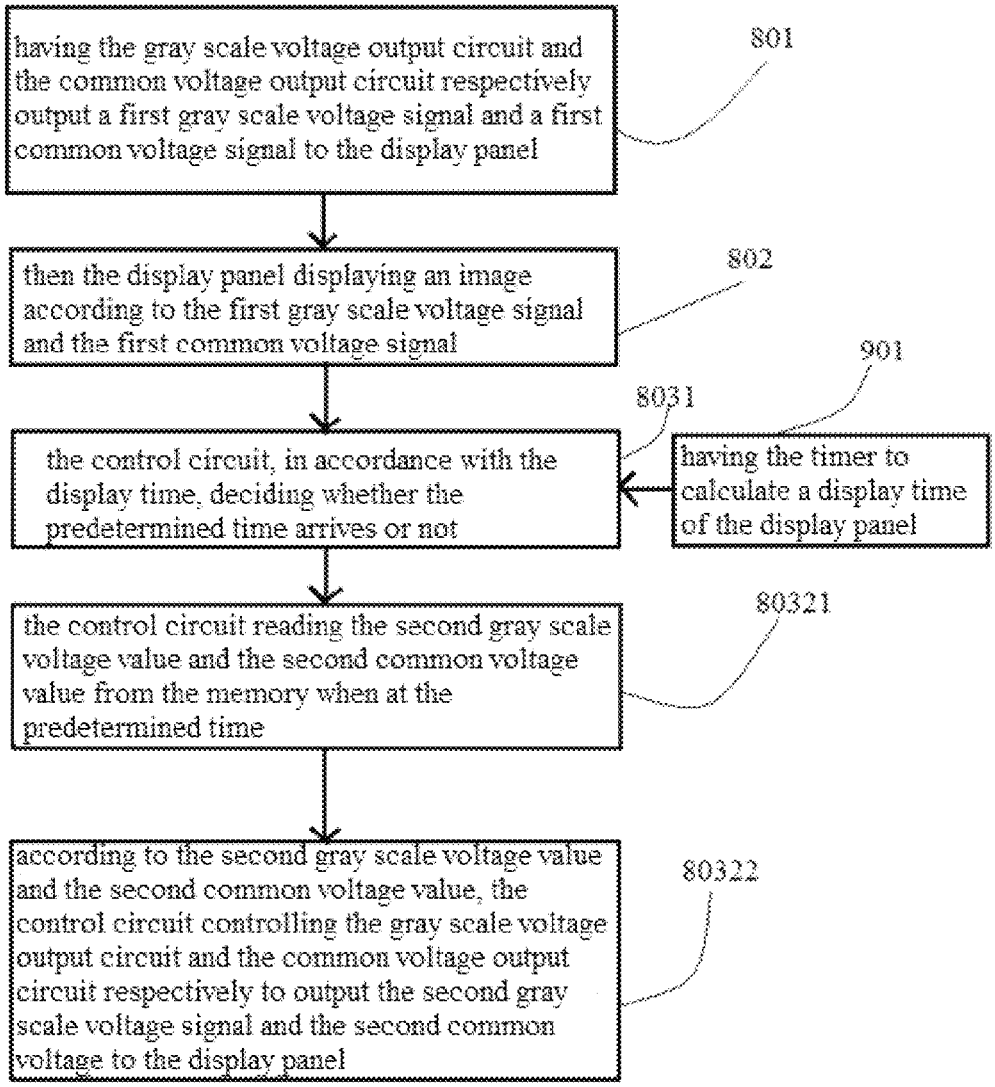
FIG. 10 is a flowchart of a third embodiment of a method for the display device displaying an image of the present invention.

Please refer to FIG. 10, which is a flowchart of a third embodiment of a method for the display device displaying an image of the present invention. The present embodiment is similar to the second embodiment, except that:

In the present embodiment, the display device further comprising a memory stored therein a second gray scale voltage value and a second common voltage value, the step c2 (i.e., Step 8032) including the following steps:

c21 (Step 80321), the control circuit 404 reads the second gray scale voltage value and the second common voltage value from the memory 601 when at the predetermined time; and c22 (Step 80322), according to the second gray scale voltage value and the second common voltage value, the control circuit 404 is used for controlling the gray scale voltage output circuit 402 and the common voltage output circuit 403 respectively to output the second gray scale voltage signal and the second common voltage to the display panel 401.

The second gray scale voltage signal corresponds to the second gray scale voltage value, and the second common voltage signal corresponds to the second common voltage value.

Figure 11:
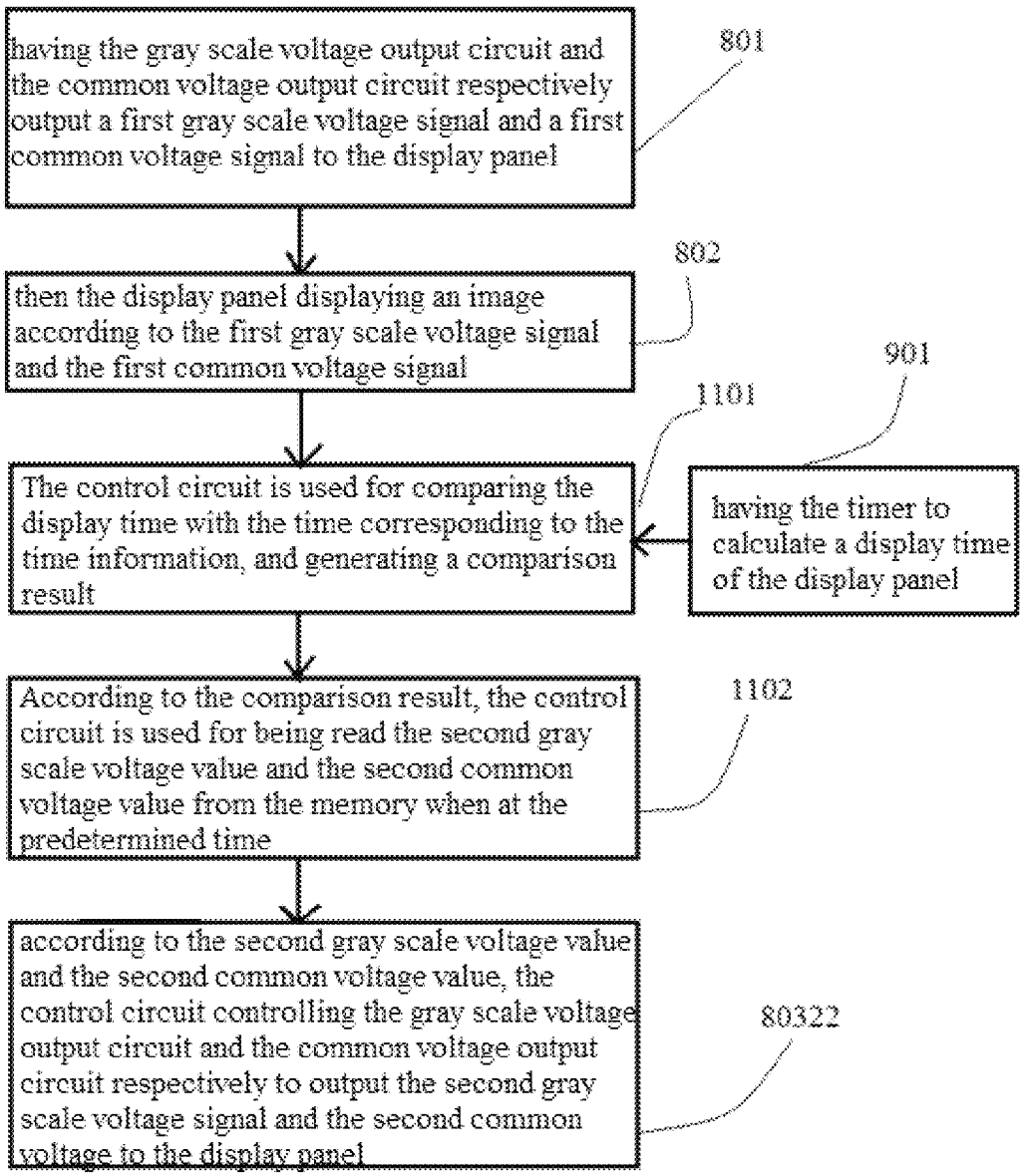
FIG. 11 is a flowchart of a fourth embodiment of a method for the display device displaying an image of the present invention.

Please refer to FIG. 11, which is a flowchart of a fourth embodiment of a method for the display device displaying an image of the present invention. The present embodiment is similar to the third embodiment, except that:

In the present embodiment, the memory 601 stores therein a set of preset data, the set of preset data includes a time information, at least one of the second gray voltage values and at least one of the second common voltage values.

The second gray scale voltage value and the second common voltage value both correspond to the time information.

The step c1 (i.e., Step 8031) includes the following step:

c11 (step 1101), the control circuit 404 is used for comparing the display time with the time corresponding to the time information, and generating a comparison result.

The step c21 (i.e., the Step 80321) includes the following step:

c211 (Step 1102), according to the comparison result, the control circuit used for reading the second gray scale voltage value and the second common voltage value from the memory 601 when at the predetermined time.

In any one embodiment of the above first embodiment to fourth embodiments, the second gray voltage value and the second common voltage value are previously measured according to display panel samples at different time points, in order to keep the blink rate of the image within the predetermined range of the desired gray scale voltage signal and the common voltage signal.

Despite the fact that present invention has been shown and described in relation to one or more implementations, those skilled in the art, based on reading and understanding the specification and drawings, would expect equivalent variations and modifications. The present invention includes all such modifications and variations, and is only limited by the scope of the appended claims. Particularly with regard to the various functions performed by the above described components, the terms used to describe such components are intended to perform the function corresponding to the specified component (e.g., that is functionally equivalent) of any component (unless otherwise indicated), even if a structure is not the same as the disclosed structure which executes the functions of the exemplary implementations in the present specification. In addition, although a particular feature of this specification has been disclosed by only one of a number of implementations, this feature can be combined with one or more other combinations of features of other implementations for given or specific applications as desired and advantageous. Furthermore, the terms "including", "having", "containing", or variations thereof as used in the detailed description or the claims are intended to be used in a manner similar to the term "comprising".

In summary, although the present invention has been described in preferred embodiments above, the preferred embodiments described above are not intended to limit the invention. One of ordinary skill in the art without departing from the spirit and scope of the invention can make all species of modifications and variations, so the protection scope of the invention is defined by the claims.

What is claimed is:

1. A display device, wherein the display device comprises:

a display panel, used to display an image according to a first gray scale voltage signal and a first common voltage signal;

a gray scale voltage output circuit, used for outputting the first gray scale voltage signal to the display panel;

a common voltage output circuit, used for outputting the first common voltage signal to the display panel;

a timer, used for calculating a display time of the display panel;

a memory storing a second gray scale voltage value and a second common voltage value; and a control circuit being used at the predetermined time for controlling the gray scale voltage output circuit and the common voltage output circuit respectively to output a second gray scale voltage signal and a second common voltage to the display panel;

wherein the second gray scale voltage signal and the second common voltage signal are supplied to the display panel for displaying another image, and for causing a blink rate of the displayed image of the display panel to be within a predetermined range;

the control circuit, used for deciding whether the predetermined time arrives or not in accordance with the display time, when at the predetermined time, controlling the gray scale voltage output circuit and the common voltage output circuit respectively to output the second gray scale voltage signal and the second common voltage signal to the display panel;

the control circuit, further used for reading the second gray scale voltage value and the second common voltage value from the memory when at the predetermined time, and according to the second gray scale voltage value and the second common voltage value, used for controlling the gray scale voltage output circuit and the common voltage output circuit respectively to output the second gray scale voltage signal and the second common voltage to the display panel;

the gray scale voltage output circuit and the common voltage output circuit both connected to the display panel, and the control circuit connected with the gray scale voltage output circuit and the common voltage output circuit;

wherein the second gray scale voltage signal corresponds to the second gray scale voltage value, the second common voltage signal corresponds to the second common voltage value;

wherein the memory stores a set of preset data, the set of preset data includes a time information, the second gray scale voltage value and the second common voltage value;

the second gray scale voltage value and the second common voltage value both corresponding to the time information;

the control circuit comparing the display time with the time corresponding to the time information, and according to the comparison, reads the second gray scale voltage value and the second common voltage value from the memory when at the predetermined time, and according to the second gray scale voltage value and the second common voltage value, and controls the gray scale voltage output circuit and the common voltage output circuit respectively to output the second gay scale voltage signal and the second common voltage to the display panel.

2. The display device according to claim 1, wherein the second gray voltage value and the second common voltage value are previously measured according to display panel samples at different time points, in order to keep the blink rate of the image within the predetermined range of the desired gray scale voltage signal and the common voltage signal.

3. A display device, comprising:

a display panel, used to display an image according to a first gray scale voltage signal and a first common voltage signal;

a gray scale voltage output circuit, used for outputting the first gray scale voltage signal to the display panel;

a common voltage output circuit, used for outputting the first common voltage signal to the display panel;

a timer, used for calculating a display time of the display panel;

a memory storing a second gray scale voltage value and a second common voltage value; and a control circuit being used at the predetermined time for controlling the gray scale voltage output circuit and the common voltage output circuit respectively to output a second gray scale voltage signal and a second common voltage to the display panel;

wherein the second gray scale voltage signal and the second common voltage signal are supplied to the display panel for displaying another image, and for causing a blink rate of the displayed image of the display panel to be within a predetermined range;

the control circuit, used for deciding whether the predetermined time arrives or not in accordance with the display time, when at the predetermined time controlling the gray scale voltage output circuit and the common voltage output circuit respectively to output the second gray scale voltage signal and the second common voltage signal to the display panel;

the control circuit, further used for reading the second gray scale voltage value and the second common voltage value from the memory when at the predetermined time, and according to the second gray scale voltage value and the second common voltage value, used for controlling the gray scale voltage output circuit and the common voltage output circuit respectively to output the second gray scale voltage signal and the second common voltage to the display panel;

wherein the second gray scale voltage signal corresponds to the second gray scale voltage value, the second common voltage signal corresponds to the second common voltage value;

wherein the memory stores a set of preset data, the set of preset data includes a time information, the second gray voltage value, and the second common voltage value;

the second gray scale voltage value and the second common voltage value both corresponding to the time information;

the control circuit comparing the display time with the time corresponding to the time information, and according to the comparison, reads the second gray scale voltage value and the second common voltage value from the memory when at the predetermined time, and according to the second gray scale voltage value and the second common voltage value, and controls the gray scale voltage output circuit and the common voltage output circuit respectively to output the second gray scale voltage signal and the second common voltage to the display panel.

4. The display device according to claim 3, wherein the second gray voltage value and the second common voltage value are previously measured according to display panel samples at different time points, in order to keep the blink rate of the image within the predetermined range of the desired gray scale voltage signal and the common voltage signal.

5. The display device according to claim 3, wherein the gray scale voltage output circuit and the common voltage output circuit both connect to the display panel, and the control circuit connects with the gray scale voltage output circuit and the common voltage output circuit.

6. A method for a display device to display images, the display device comprising a display panel, a gray scale voltage output circuit in connection with the display panel, a common voltage output circuit in connection with the display panel, a control circuit in connection with both the gray scale voltage output circuit and the common voltage output circuit, a timer and a memory both in electrical connection with the control circuit, wherein the method includes the following steps:

A, having the gray scale voltage output circuit and the common voltage output circuit respectively output a first gray scale voltage signal and a first common voltage signal to the display panel;

B, then the display panel displaying an image according to the first gray scale voltage signal and the first common voltage signal; and C, when at a predetermined time thereafter, the control circuit controlling the gray scale voltage output circuit and the common voltage output circuit respectively to output a second gray scale voltage signal and a second common voltage to the display panel;

wherein the second gray scale voltage signal and the second common voltage signal are supplied to the display panel for displaying another image, and for causing the blink rate of the displayed images of the display panel to be within a predetermined range;

D, having the timer to calculate a display time of the display panel;

the step C including:

c1, the control circuit, in accordance with the display time, deciding whether the predetermined time arrives or not; and c2, when at the predetermined time, controlling the gray scale voltage output circuit and the common voltage output circuit respectively to output the second gray scale voltage signal and the second common voltage signal to the display panel;

the memory storing a second gray scale voltage value and a second common voltage value, wherein the step c2 includes:

c21, the control circuit reading the second gray scale voltage value and the second common voltage value from the memory when at the predetermined time; and c22, according to the second gray scale voltage value and the second common voltage value, the control circuit controlling the gray scale voltage output circuit and the common voltage output circuit respectively to output the second gay scale voltage signal and the second common voltage to the display panel;

wherein the second gray scale voltage signal corresponds to the second gray scale voltage value, and the second common voltage signal corresponds to the second common voltage value;

wherein the memory stores a set of preset data, the set of preset data includes a time information, the second gray voltage value and the second common voltage value, and the second gray scale voltage value and the second common voltage value both correspond to the time information;

wherein the step c1 including:

c11, the control circuit comparing the display time with the time corresponding to the time information;

the step c21 including:

c211, according to the comparison, the control circuit reading the second gray scale voltage value and the second common voltage value from the memory when at the predetermined time.

7. The method for the display device displaying images according to claim 6, wherein the second gray voltage value and the second common voltage value are previously measured according to display panel samples at different time points, in order to keep the blink rate of the image within the predetermined range of desired gray scale voltage signal and the common voltage signal.

* * * * *